US009790068B1

(12) United States Patent
Brauer et al.

(10) Patent No.: US 9,790,068 B1
(45) **Date of Patent: *Oct. 17, 2017**

(54) LIFT TRUCK PLATFORM APPARATUS AND METHODS FOR TRANSPORTING ROLLING RACKS

(71) Applicant: Jeffrey L. Brauer, Gallatin, TN (US)

(72) Inventors: Jeffrey L. Brauer, Gallatin, TN (US); Todd M. Scheriger, Hendersonville, TN (US); Jonathan A. Pond, Hendersonville, TN (US)

(73) Assignee: Jeffrey L. Brauer, Gallatin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/518,972

(22) Filed: Oct. 20, 2014

Related U.S. Application Data

(63) Continuation of application No. 13/554,314, filed on Jul. 20, 2012, now Pat. No. 8,894,037.

(60) Provisional application No. 61/509,697, filed on Jul. 20, 2011.

(51) Int. Cl.
*B66F 9/12* (2006.01)

(52) U.S. Cl.
CPC ..... *B66F 9/12* (2013.01)

(58) Field of Classification Search
CPC . B65D 19/44; B65D 2519/00815; B66F 9/12; B66F 9/122; B66F 9/125; B66F 9/127; B66F 9/14; B66F 9/18; B66F 9/183; B66F 9/184
USPC ..... 254/2 C; 108/55.1, 55.3, 57.15, 57.16, 108/57.17, 57.2, 57.21, 57.22, 57.23, 108/57.24, 57.29; 211/85.3; 269/55, 269/134, 254 R, 37, 44, 45
See application file for complete search history.

(56) References Cited

U.S. PATENT DOCUMENTS

| | | | | |
|---|---|---|---|---|
| 2,523,271 | A * | 9/1950 | Bartel | 108/55.3 |
| 4,230,050 | A * | 10/1980 | Mays | 108/57.17 |
| 4,230,051 | A * | 10/1980 | Mays | 108/55.1 |
| 4,515,506 | A * | 5/1985 | Van Gompel et al. | 410/46 |
| 5,299,691 | A * | 4/1994 | Winski | 206/527 |
| 5,398,832 | A * | 3/1995 | Clive-Smith | 220/1.5 |
| 5,533,456 | A * | 7/1996 | Regina | 108/57.29 |
| 5,787,817 | A * | 8/1998 | Heil | 108/57.21 |
| 6,029,718 | A * | 2/2000 | Jackson et al. | 141/231 |
| 6,240,854 | B1 * | 6/2001 | Heil | 108/51.11 |
| 6,298,999 | B1 * | 10/2001 | Bellman | 211/24 |
| 6,360,676 | B1 * | 3/2002 | Schepers | 108/52.1 |
| 6,502,696 | B2 * | 1/2003 | Heinrichs | 206/443 |
| 7,445,184 | B1 * | 11/2008 | Johnson | B05B 13/0285 248/176.1 |
| 7,918,165 | B2 * | 4/2011 | Owen | 108/55.1 |
| 8,256,357 | B2 * | 9/2012 | Kelly et al. | 108/55.5 |
| 8,763,990 | B2 * | 7/2014 | Day | 254/2 R |
| 9,139,335 | B2 | 9/2015 | Månsson | |

(Continued)

*Primary Examiner* — Larry E Waggle, Jr.
*Assistant Examiner* — Henry Hong
(74) *Attorney, Agent, or Firm* — Bradley Arant Boult Cummings; Phillip E. Walker; Timothy L. Capria

(57) ABSTRACT

A lift truck platform apparatus for transporting rolling racks provides a platform and a frame extending upwardly from the platform. A clamp is attached to the frame. The clamp is vertically moveable relative to the platform for selectively engaging and securing in place the rolling racks when the rolling racks are loaded on the platform. The clamp is vertically moveable away from the platform for releasing the rolling racks.

16 Claims, 8 Drawing Sheets

(56) References Cited

U.S. PATENT DOCUMENTS

| | | | | |
|---|---|---|---|---|
| 2007/0017421 | A1* | 1/2007 | Kumpel | 108/57.15 |
| 2009/0053033 | A1* | 2/2009 | Barbalho et al. | 414/802 |
| 2009/0127215 | A1* | 5/2009 | Gale | A47F 7/08 211/85.3 |
| 2012/0145049 | A1* | 6/2012 | Schumacher | 108/55.1 |
| 2014/0196634 | A1* | 7/2014 | Mansson | 108/55.1 |

* cited by examiner

LIFT TRUCK PLATFORM APPARATUS AND METHODS FOR TRANSPORTING ROLLING RACKS

This application is a continuation application of co-pending U.S. application Ser. No. 13/554,314 filed Jul. 20, 2012 entitled "Lift Truck Platform Apparatus and Methods for Transporting Rolling Racks", which is a non-provisional U.S. Application No. 61/509,697 filed Jul. 20, 2011 entitled "Lift Truck Platform apparatus and Methods for Transporting Rolling Racks", both of which are hereby incorporated by reference in their entireties.

We, Jeffrey L. Brauer, a citizen of the United States, residing in Gallatin, Tenn.; Todd M. Scheriger, a citizen of the United States, residing in Gallatin, Tenn.; and Jonathan A. Pond, a citizen of the United States, residing in Gallatin, Tenn.; have invented a new and useful "Lift Truck Platform apparatus and Methods for Transporting Rolling Racks."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND

Technical Field

The present disclosure relates to material handling systems and more particularly to devices and methods for transporting rolling racks using a lift truck such as a forklift, pallet jack or a pallet truck.

Background Art

Lift trucks such as pallet trucks, pallet jacks and forklifts are known in the art for moving materials. Such devices generally include a moveable base having one or more arms extending outwardly from the base. The arms are vertically moveable for lifting and lowering materials. When the arms are in a raised position, the base may be moved by an operator, either manually or with the use of a motor, thereby transporting material that is supported by the arms.

One problem associated with conventional forklifts, pallet jacks and pallet trucks is encountered when trying to transport rolling racks. Rolling racks generally include racks or shelves that have roller wheels on the bottom. The wheels allow the racks to be easily moved along the ground. In many applications, such as in a warehouse or in a container truck, it is desirable to move multiple rolling racks at once. Such racks may be empty or may be pre-loaded with other types of materials. It is generally inefficient to roll individual rolling racks over great distances. Others have attempted to load rolling racks on pallets or other types of rack holding platforms for transport using forklifts or pallet trucks. However, rolling racks have a tendency to roll off of such conventional pallets and platforms, complicating the transport process.

What is needed then are improvements in the devices and methods for transporting rolling racks using lift trucks such as forklifts, pallet jacks and pallet trucks.

BRIEF SUMMARY

The present disclosure provides devices and methods for transporting rolling racks using a lift truck such as a pallet truck, pallet jack or a forklift.

In some embodiments, the present disclosure provides an apparatus for transporting one or more rolling racks using a lift truck having first and second forks extending therefrom. The forks may be attached to a vertically moveable carriage on the lift truck in some embodiments. The forks have a raised position and a lowered position. A lift truck platform apparatus having a platform is positioned on the first and second forks. In some embodiments, the platform includes a first fork channel shaped to receive the first fork and a second fork channel shaped to receive the second fork. A frame extends upwardly from the platform. A moveable clamp can be disposed at the top of the frame. The clamp can be configured to disengage from the rolling racks when the forks are moved to the lowered position and to engage the rolling racks when the forks are moved to the raised position.

In another embodiment, the present disclosure provides a method of transporting rolling racks on a lift truck having a lift truck platform and a moveable rack clamp. The method includes positioning the rolling rack on the platform and moving the platform relative to the rack clamp such that the clamp engages the rolling rack.

Numerous other objects, features and advantages of the present disclosure will be readily apparent to those skilled in the art upon a reading of the following description when taken in conjunction with the accompanying drawings.

DETAILED DESCRIPTION

Figure 1:
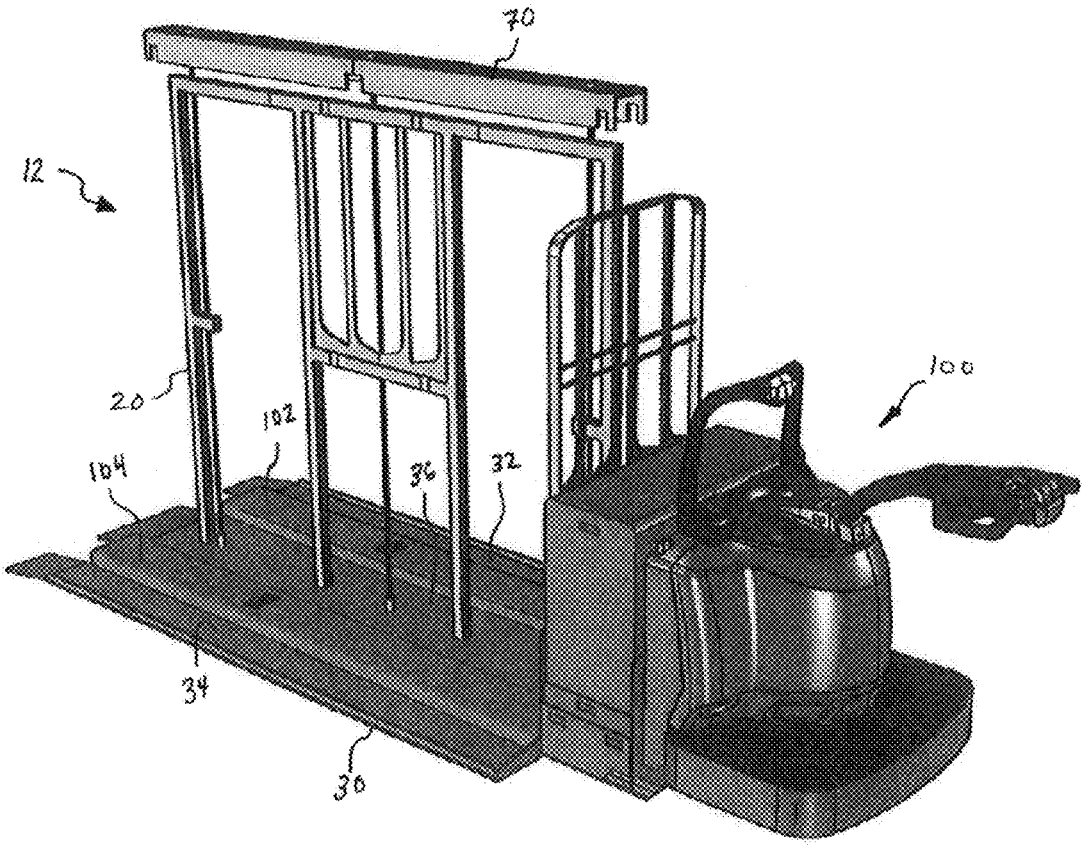
FIG. 1 illustrates a perspective view of a lift truck with a platform, frame and rack clamp mounted thereon.

It is understood that in the drawings, not all reference numbers are included in each drawing, for the sake of clarity.

In addition, positional terms such as a "upper," "lower," "side," "top," "bottom," "vertical," "horizontal," etc. refer to the apparatus when in the orientation shown in the drawing. The skilled artisan will recognize that objects in accordance with the present disclosure can assume different orientations when in use.

Referring now to the drawings, the present disclosure provides a lift truck platform apparatus, designated by the numeral 12. Referring to FIG. 1, an embodiment of a lift truck platform apparatus 12 is disposed on a lift truck 100 in accordance with the present disclosure. Lift truck 100 can include any variety of mobile lift truck, such as a manual or powered fork lift, a manual or powered pallet truck or a manual or powered pallet jack.

The lift truck platform apparatus 12 includes a platform 30, or base, and a frame 20 extending upwardly from the platform 30. A clamp 70 is attached to the frame 20. Clamp 70 is generally moveable relative to platform 30. Platform 30 can be vertically moveable relative to clamp 70. The platform 30 can include a first outer wheel tray 32 operatively attached to first fork 102, a second outer wheel tray 34 operatively attached to second fork 104 and a middle wheel tray 36 operatively attached to first and second forks 102, 104 and spanning the gap between first and second forks 102, 104.

In some embodiments, first and second outer wheel trays 32, 34 and middle wheel tray 36 are all flat sheets of metal that are welded onto each respective fork. As such, each wheel tray is rigidly attached directly to the forks on lift truck 100. In other embodiments, it may be desirable to provide a lift truck platform apparatus 12 that is not welded directly onto the forks 102 and 104 of a lift truck 100. Instead, it may be desirable to provide a lift truck platform apparatus 12 that includes an attachment that can be mounted on and subsequently removed from the forks of an existing lift truck 100. An embodiment of such a lift truck platform apparatus 12 is seen generally in FIG. 2.

In this embodiment, lift truck platform apparatus 12 includes a platform 30 having a plurality of channels 38 and 40 formed therein. In some embodiments, platform 30 may include a single piece of stamped or pressed metal. In other embodiments, platform 30 includes a plurality of metal sheets welded together. A first fork channel 40 can be defined on platform 30 and can be generally configured to receive a first fork 102 of a lift truck 100. First fork channel 40 may include a rectangular profile and can be open to the bottom of platform 30. Similarly, a second fork channel 38 can be defined on platform 30. Second fork channel 38 can be generally configured to receive a second fork 104 on a lift truck 100. Second fork channel 38 also may include a rectangular profile and can be open to the bottom of platform 30.

First and second fork channels 38 and 40 are separated by a middle wheel tray 36. Middle wheel tray 36 is generally forms a concave channel open to the top of platform 30. Middle wheel tray 36 can be generally configured to receive one or more wheels of a rolling rack 120. A frame 20 extends upwardly from middle wheel tray 36 in some embodiments, thereby bisecting platform 30 into a first side and a second side. One or more rolling racks 120 may be positioned on the first and/or second side of platform 30. Rolling racks 120 may include conventional rolltainers, or rolling carts, in some applications.

Figure 2:
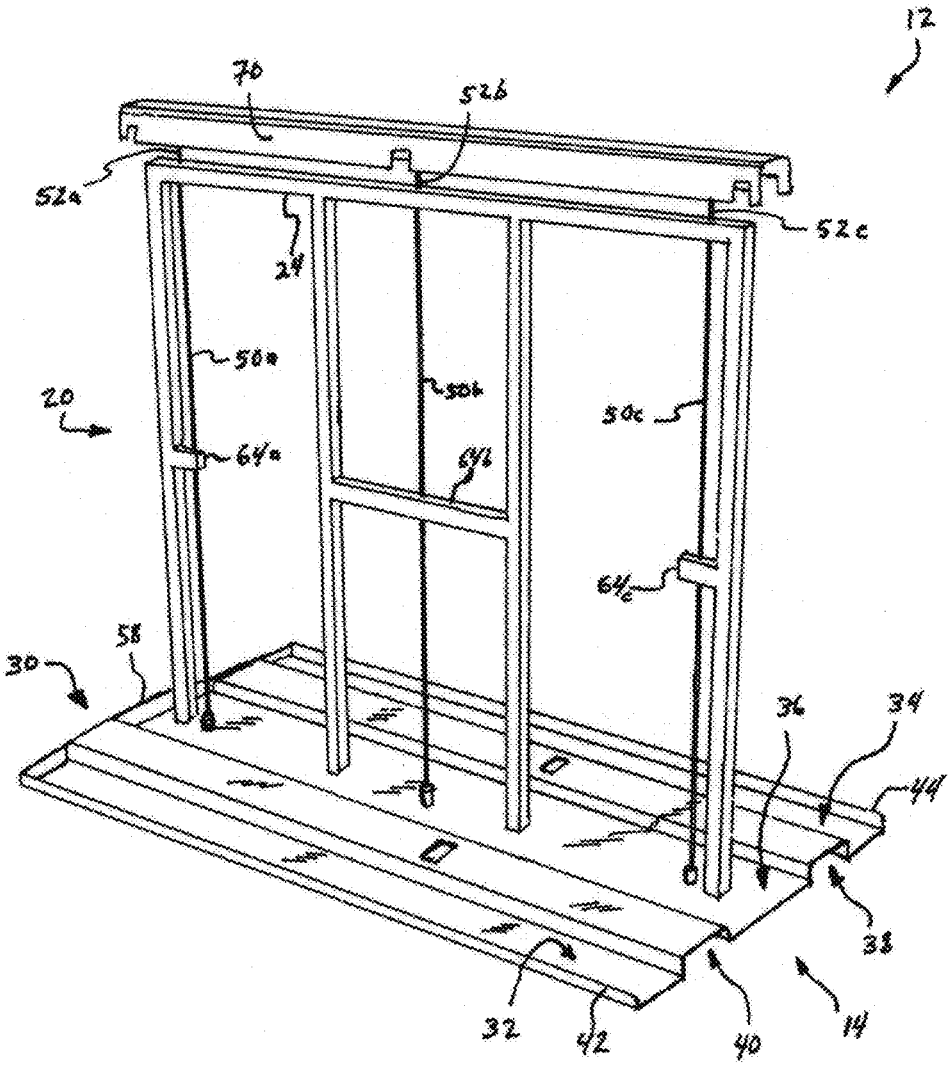
FIG. 2 illustrates a perspective view of an embodiment of a fork attachment for mounting on a lift truck for transporting rolling racks.

Also seen in FIG. 2, in some embodiments, a first outer wheel tray 32 is defined in platform 30. First outer wheel tray 32 is configured to receive one or more wheels on a rolling rack 120. First outer wheel tray 32 includes a first outer wheel guide 42, or first flange, extending upwardly from the outermost longitudinal edge of first outer wheel tray 32. First outer wheel guide 42, or first flange, provides a support for preventing one or more wheels of a rolling rack 120 from rolling off of the first side of the platform 30. First outer wheel tray 32 together with first outer wheel guide 42 and first fork channel 40 provides a concave shape opening to the top of platform 30.

Also seen in FIG. 2, a second outer wheel tray 34 is disposed on platform 30. Second outer wheel tray 34 is configured to receive one or more wheels of a rolling rack 120. A second outer wheel guide 44, or second flange, extends upwardly from the outermost longitudinal edge of second outer wheel tray 34. Second outer wheel guide 44 provides a support for preventing one or more wheels of rolling racks 120 from rolling off the second side of the platform 30. Second outer wheel tray 34 together with second outer wheel guide 44 and second fork channel 38 provides a concave shape opening to the top of platform 30.

Platform 30, in some embodiments, includes a loading end 14 positioned along a lateral edge of the platform 30. Loading end 14 generally forms the end of platform 30 where rolling racks 120 are rolled onto the platform 30. An end flange 58 extends upward from platform 30 at the lateral edge opposite the loading end 14. The end flange 58 is configured to block passage of one or more rolling racks 120 through first and second outer wheel trays 32, 34 and middle wheel tray 36. One or more loading ramps 90*a*, 90*b*, 90*c* may be disposed adjacent a corresponding wheel tray in some embodiments to facilitate rolling of racks onto platform 30. In some embodiments, each loading ramp may be hinged relative to platform 30 or alternately welded to the platform 30. In additional embodiments, each loading ramp may be integral to each respective loading tray and may extend longitudinally no further than the lateral end of each wheel tray, as seen in FIG. 2, to prevent the loading ramps from protruding from platform 30.

Regardless of whether platform 30 is welded directly onto the forks, as seen in FIG. 1, or is included as a modular attachment for placement onto and removal from the forks of an existing lift truck, as seen in FIG. 2, a frame 20 extends upwardly from platform 30. Frame 20 includes one or more horizontal members and one or more vertical members. The various members of frame 20 may be welded together in some embodiments. In other embodiments, various members of frame 20 may be secured together by mechanical fasteners or formed as combined or integral pieces, such as by casting or molding.

Figure 3:
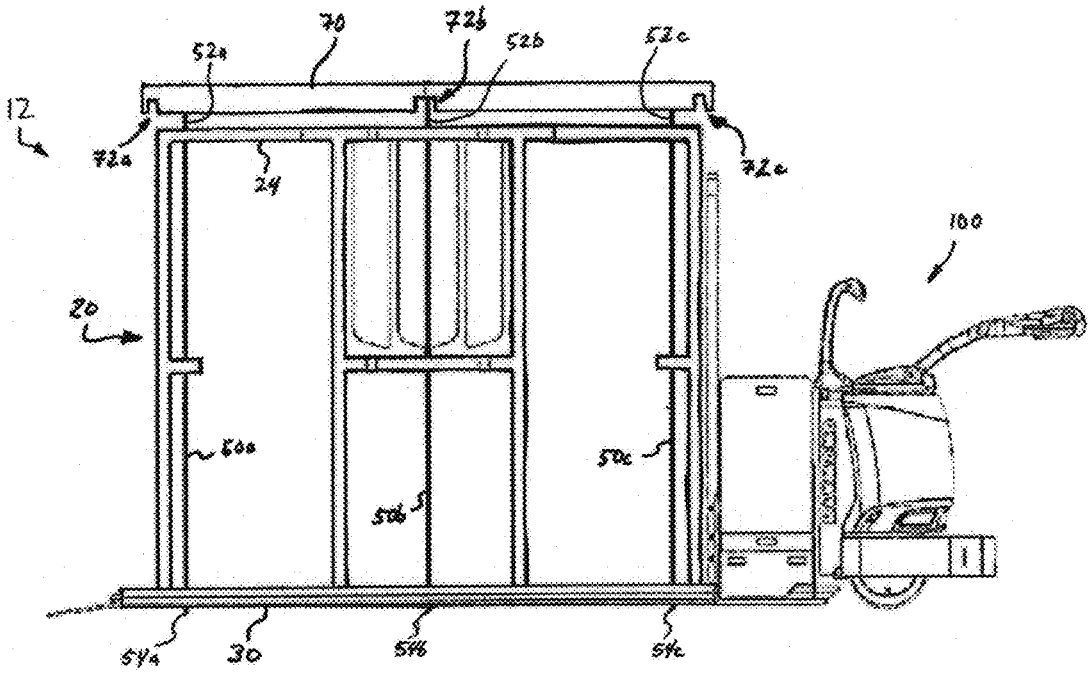
FIG. 3 illustrates an elevation view of an embodiment of a fork attachment mounted on a lift truck for transporting rolling racks.

As seen in FIG. 2 and FIG. 3, in some embodiments, a clamp 70 is disposed at the top of frame 20. Clamp 70 can be supported by a plurality of clamp rods 50*a*, 50*b*, 50*c* that extend downwardly from clamp 70. Each clamp rod 50*a*, 50*b*, 50*c* can be rigidly secured to clamp 70 and can extend through an upper horizontal member 24 on frame 20. Each clamp rod 50*a*, 50*b*, 50*c* may slidably extend through a corresponding hole defined in upper horizontal member 24. In additional embodiments, one or more clamp rods may slidably extend through a bracket, or fitting, positioned on the upper horizontal member 24. Clamp rods 50*a*, 50*b*, 50*c* further extend through corresponding holes in platform 30.

As seen in FIG. 3, each clamp rod includes an upper clamp rod end 52*a*, 52*b*, 52*c*, respectfully, extending above upper horizontal member 24 and a lower clamp rod end 54*a*, 54*b*, 54*c*, respectfully, extending below platform 30. For example, first clamp rod 50*a* includes a first upper clamp rod end 52*a* and a lower clamp rod end 54*a*. Second clamp rod 50*b* includes a second upper clamp rod end 52*b* and a second lower clamp rod end 54*b*. Third clamp rod 50*c* includes a third upper clamp rod end 52*c* and a third lower clamp rod end 54*c*. Each upper clamp rod end 52*a*, 52*b*, 52*c* is secured to clamp 70. Each lower clamp rod end 54*a*, 54*b*, 54*c* extends below platform 30. It will be readily appreciated by those of skill in the art that, in some embodiments, the actual clamp rods themselves 50*a*, 50*b*, 50*b* may not extend above upper horizontal member 24 and below platform 30, but may include one or more rod fittings attached to an upper and/or lower end of each clamp rod 50*a*, 50*b*, 50*c*, etc., and each respective fitting may include the structure that extends above upper horizontal member 24 or below platform 30.

Also seen in FIG. 2 and FIG. 3, a first clamp rod guide 64*a* may extend horizontally from a vertical member on frame 20 for supporting first clamp rod 50*a*. First clamp rod guide 64*a* generally includes a hole defined therein through which first clamp rod 50*a* is free to longitudinally translate. Similarly, a second clamp rod guide 64*b* may extend from the same or from a different vertical member of frame 20. Second clamp rod guide 64*b* generally includes a hole defined therein through which second clamp rod 50*b* is free to longitudinally translate. Also, a third clamp rod guide 64*c* may extend from the same or from a different vertical member of frame 20. Third clamp rod guide 64*c* generally includes a hole defined therein through which third clamp rod 50*c* is free to longitudinally translate. As seen in FIG. 2, in some embodiments, the various clamp rod guides may connect to only one vertical member in a cantilevered fashion, such as first and third guide rods 64*a*, 64*c*. In some applications, such cantilevered clamp rod guides may have a tendency to get caught in netting or other structural features of objects loaded on platform 30. To prevent this, one or more clamp rod guides may extend between adjacent vertical members in a continuous bar, such as second clamp rod guide 64*b*.

Figure 7A:
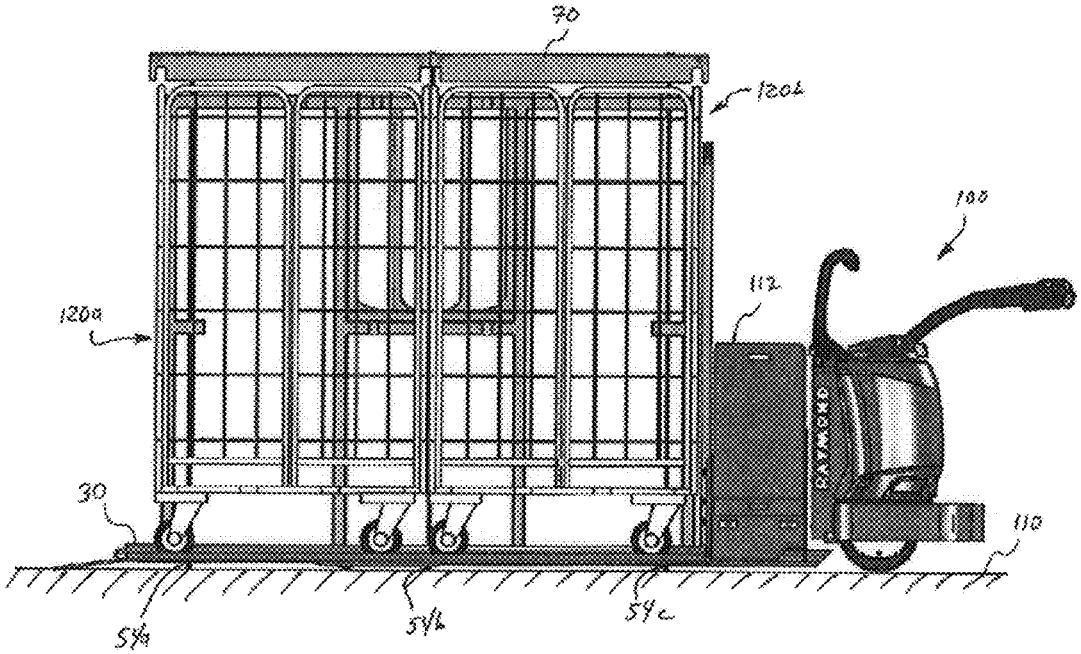
FIG. 7A illustrates an embodiment of a lift truck platform positioned on a lift truck and having a plurality of rolling racks disposed thereon with the lift truck forks in the lowered position such that the rack clamp is in the disengaged position.
Figure 7B:
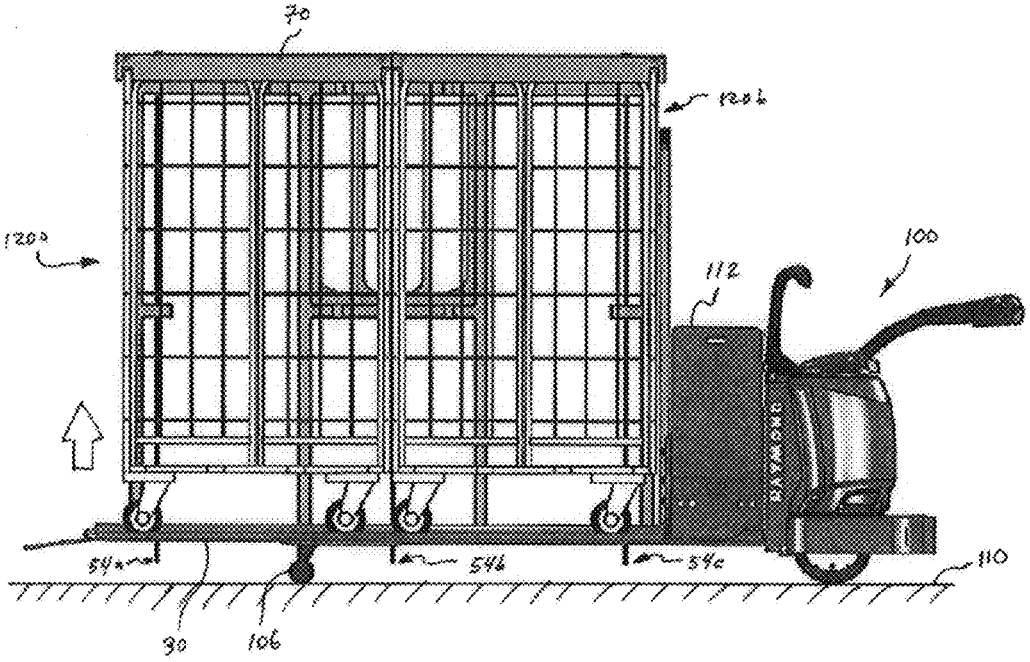
FIG. 7B illustrates the embodiment of a lift truck platform apparatus of FIG. 7A with the lift truck forks in the raised position such that the rack clamp is in the engaged position.

Each clamp rod 50*a*, 50*b*, 50*c* extends through a corresponding hole in platform 30. Each clamp rod 50*a*, 50*b*, 50*c* includes a lower clamp rod end 54*a*, 54*b*, 54*c*, respectively, or a clamp rod fitting as noted above, protruding below platform 30. Platform 30 may be raised and lowered using a lift truck 100. Referring to FIG. 7A, in some embodiments, lift truck 100 includes a carriage 112 that may be raised or lowered. First and second forks 102, 104 extend from carriage 112, and platform 30 is positioned on first and second forks 102, 104. In other embodiments, first and second forks 102, 104 are vertically moveable without a common carriage. When first and second lift truck forks are lowered, platform 30 is lowered. When first and second lift truck forks are raised, platform 30 is raised. When first and second forks are positioned in a lowered position, as seen in FIG. 3 and FIG. 7A, each lower clamp rod end 54*a*, 54*b*, 54*c* engages the ground. Each clamp rod 50*a*, 50*b*, 50*c*, or each clamp rod together with any fittings disposed thereon, is longer than the height of frame 20 and platform 30, thereby allowing lower clamp rod ends 54*a*, 54*b*, 54*c* to protrude from the bottom of platform 20. Thus, when the first and second forks are in the lowered position, lower clamp rod ends 54*a*, 54*b*, 54*c* engage the ground 110, which in turn causes clamp 70 to raised relative to upper horizontal member 24 on frame 20. In such a position, clamp 70 is in a raised clamp position, or open position.

Although the embodiments depicted in FIG. 2 and FIG. 3 include three clamp rods, it will be readily appreciated by those of skill in the art that various other embodiments having fewer than three or more than three clamp rods and/or corresponding clamp rod guides are also encompassed within the scope of the present disclosure.

Figure 4:
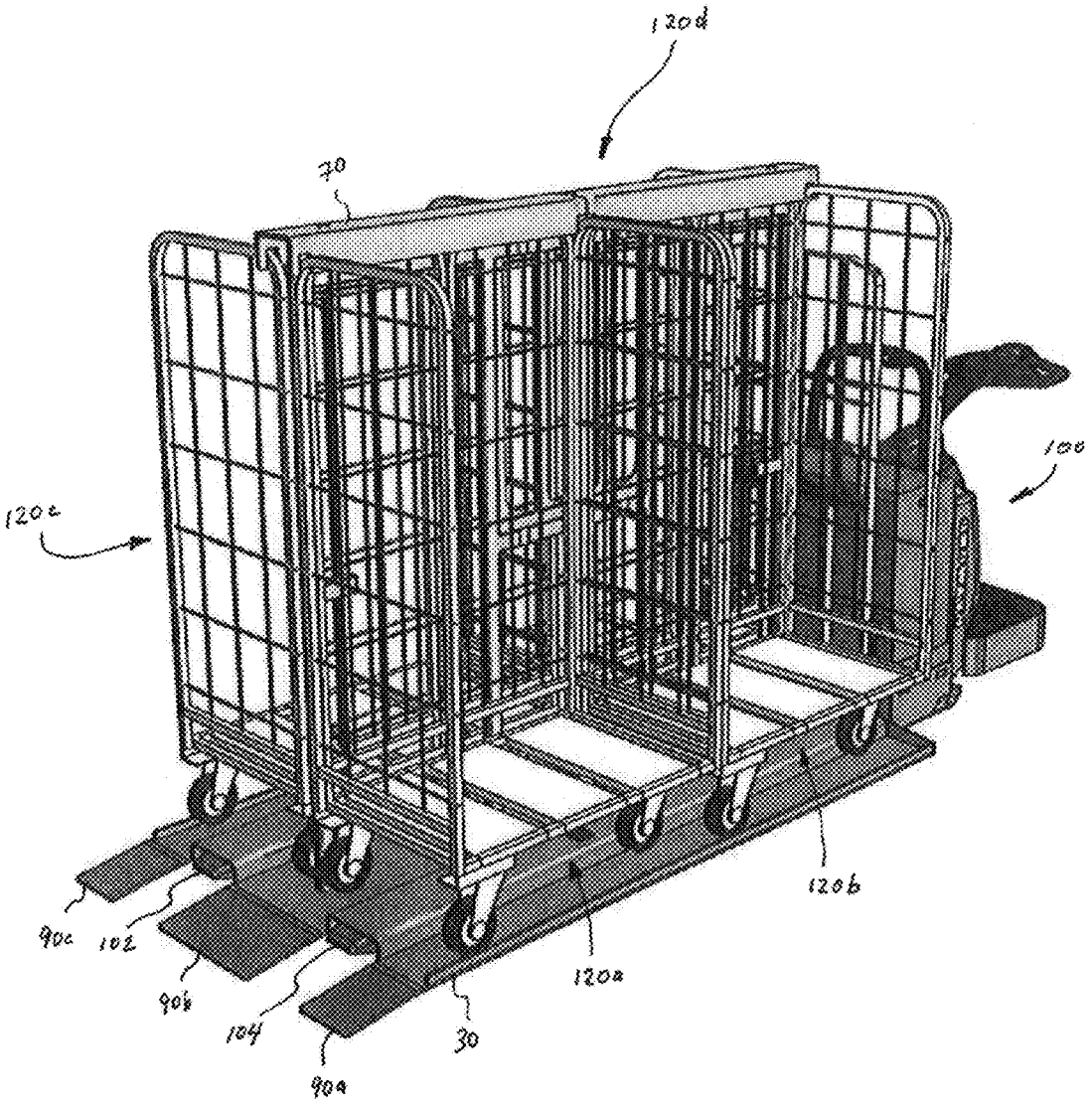
FIG. 4 illustrates a perspective view of an embodiment of a lift truck platform having a plurality of rolling racks secured thereon.
Figure 5:
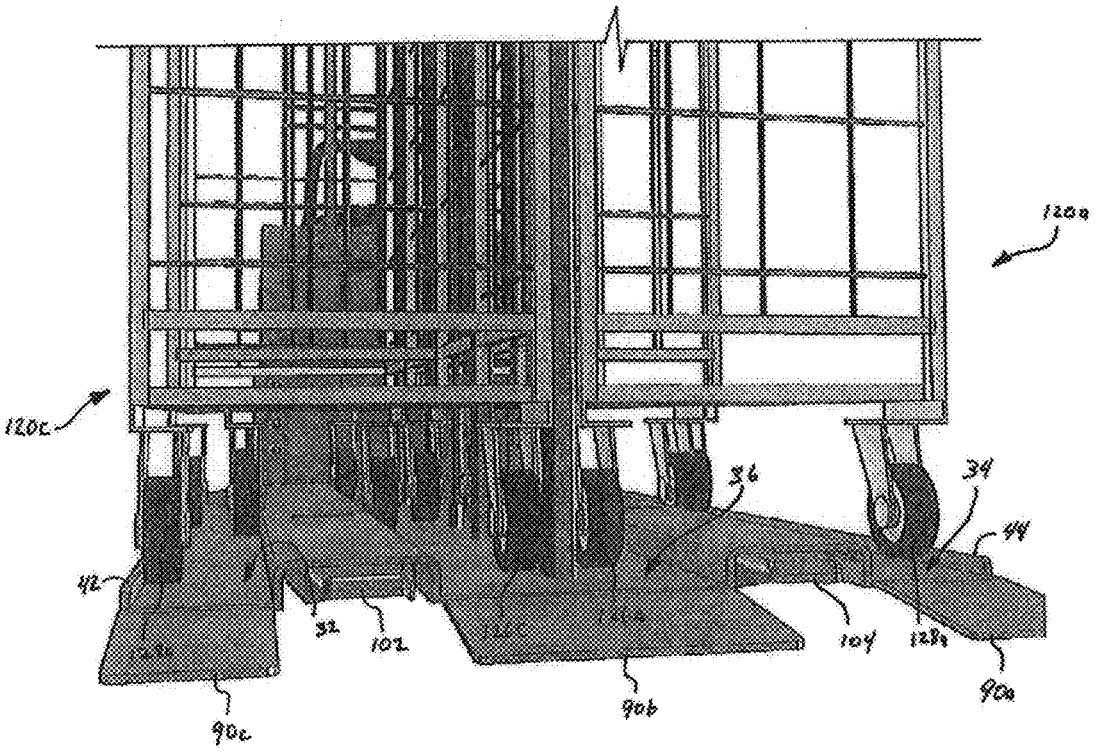
FIG. 5 illustrates a detail perspective view of an embodiment of a lift truck platform having a plurality of rolling racks secured thereon.
Figure 6A:
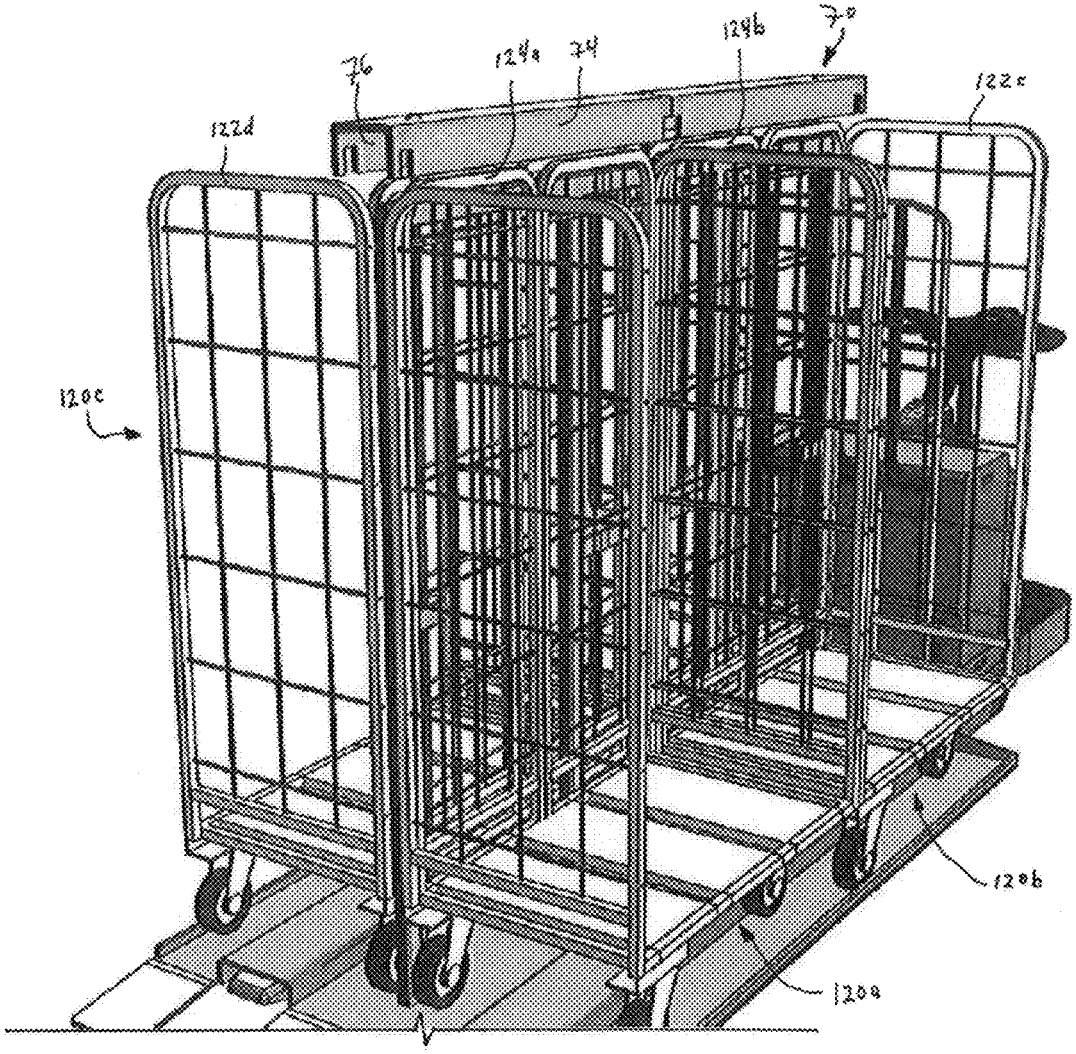
FIG. 6A illustrates a partial perspective view of an embodiment of a lift truck platform having a plurality of rolling racks disposed thereon with a rack clamp in a disengaged position.

Referring now to FIG. 5 and FIG. 6A, when clamp 70 is in the raised clamp position, and when platform 30 in the lowered position, one or more rolling racks 120*a*, 120*b*, 120*c*, etc. may be rolled onto platform 30. In some embodiments, platform 30 is dimensioned to accommodate four rolling racks 120—two on the first side of platform 30 and two on the second side of platform 30, as seen in FIG. 4. Each rolling rack 120 generally includes one or more inner rack wheels that are rolled into middle wheel tray 36 and one or more outer rack wheels that are rolled onto either first or second outer wheel trays 32 or 34.

For example, as seen in FIG. 5, in some embodiments first rolling rack 120*a* includes a first inner wheel 126*a* that rolls onto middle wheel track 36 and a first outer wheel 128*a* that rolls onto second outer wheel track 34. Similarly, second rolling rack 120*b* may be positioned on platform 30, as seen in FIG. 4, such that its wheels engage platform 30 in a similar fashion. As seen in FIG. 5, a third rolling rack 120*c* may be rolled onto platform such that third inner wheel 126*c* engages middle wheel track 36 and third outer wheel 128*c* engages first outer wheel track 32. A fourth rolling rack 120*d* may be loaded onto platform 30 in a similar fashion.

In some embodiments, the distance between frame 20 and first outer wheel guide 42 is substantially the same or slightly greater than the distance between the inner and outer wheels on a rolling rack loaded on the first side of platform 30. Similarly, the distance between frame 20 and second outer wheel guide 42 is substantially the same or slightly greater than the distance between inner and outer wheels on a rolling rack loaded on the second side of platform 30.

Figure 6B:
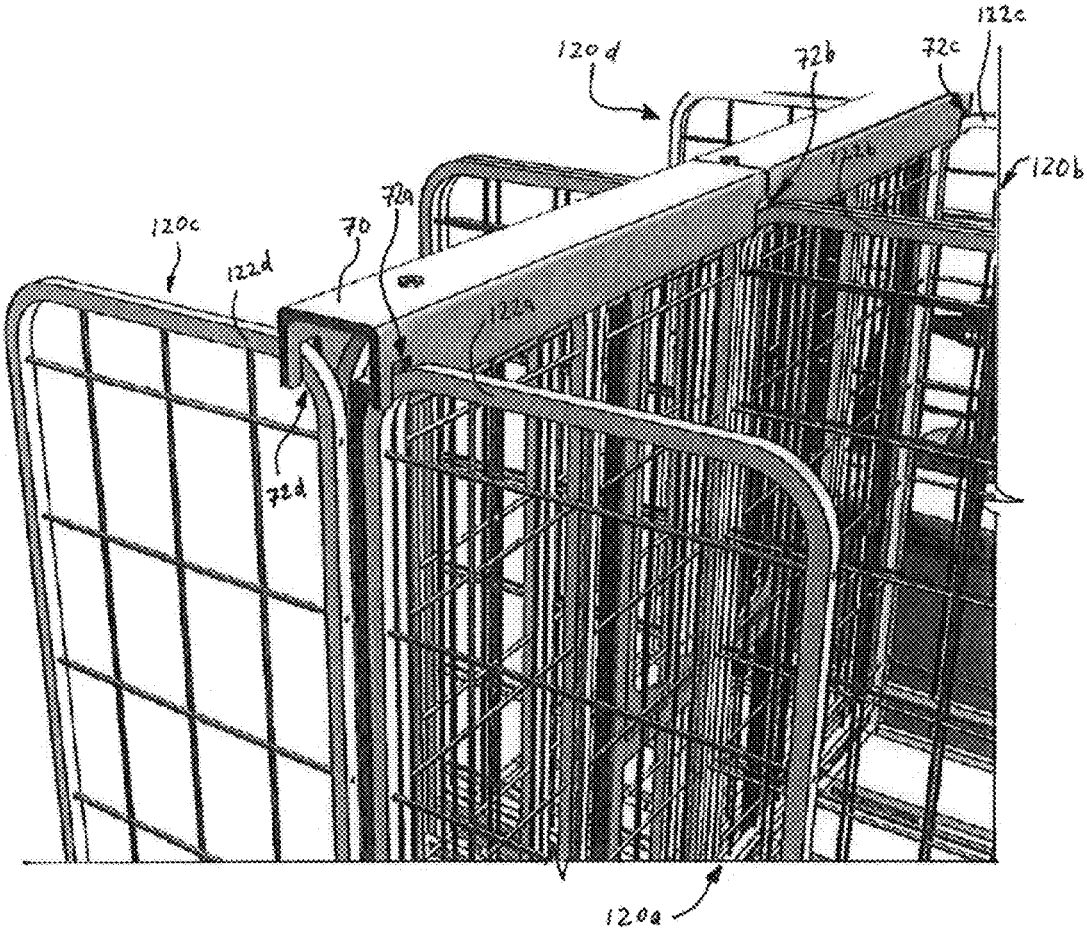
FIG. 6B illustrates a partial perspective view of an embodiment of a lift truck platform having a plurality of rolling racks disposed thereon with a rack clamp in an engaged position.

As seen in FIG. 6A, when rolling racks 120*a*, 120*b*, 120*c*, etc. are loaded onto lift truck platform apparatus 12, and particularly onto platform 30, clamp 70 is generally in the raised clamp position. As seen in FIG. 3 and FIG. 6B, clamp 70 includes a plurality of clamp recesses shaped to partially receive corresponding structures on the rolling racks when clamp 70 is moved from the raised clamp position, seen in FIG. 6A, to the lowered clamp position, or closed position, seen in FIG. 6B. For example, in some embodiments, clamp 70 includes a first clamp recess 72*a* shaped to receive first side bar 122*a* on first rolling rack 120*a* when clamp 70 is moved to the lowered clamp position. At the same time, a downwardly extending flange of clamp 70 adjacent first clamp recess 72*a* extends from clamp 70 a sufficient distance to cover a first longitudinal bar 124*a* on first rolling rack, seen in FIG. 6A, when clamp 70 is moved to the lowered clamp position, seen in FIG. 6B. Clamp 70 can include an upside-down U-shaped cross-sectional profile that retains first longitudinal bar 124*a* between frame 20 and clamp 70 when clamp 70 is moved into the lowered clamp position, as seen in FIG. 6B. As such, clamp 70 prevents first rolling rack 120*a* from tipping over away from frame 20 when first rolling rack 120*a* is loaded on the lift truck platform apparatus 12.

Other rolling racks 120*b*, 120*c*, 120*d* may also be retained on lift attachment 12 using clamp 70 in the lowered position. Multiple clamp recesses 72*a*, 72*b*, 72*c*, 72*d*, etc. may be formed in clamp 70 to accommodate side bars on rolling racks, thereby adding additional security and allowing clamp 70 to move to the lowered clamp position without interfering with side bars on the rolling racks. For example, second clamp recess 72*b* receives second side bar 122*b*, third clamp recess 72*c* receives third side bar 122*c*, fourth clamp recess 72*d* receives fourth side bar 122*d*, etc. Additional downwardly extending flanges on the U-shaped clamp 70 engage longitudinal bars on respective rolling racks to prevent relative movement between the lift attachment 12 and said rolling rack 120, such as tipping over, sliding, rolling, etc.

In some embodiments, clamp 70 moves from the raised clamp position, seen in FIG. 6A to the lowered clamp position, seen in FIG. 6B by raising the platform 30 using first and second forks. Because first, second and third clamp rods 50*a*, 50*b*, 50*c* are free to travel through upper horizontal member 24 and platform 30, as well as first, second and third clamp rod guides 64*a*, 64*b*, 64*c*, all three clamp rods 50 and clamp 70 may move relative to platform 30 when platform 30 is raised. In other words, platform 30 may be raised relative to clamp 70 and clamp rods 50*a*, 50*b*, 50*c* such that clamp 70 covers lateral bars 124 on rolling racks 120 and such that side bars 122 on rolling racks are received in clamp recesses 72. By lifting platform 30, the vertical distance between clamp 70 and platform 30 is decreased.

Preferably, clamp 70 along with first, second and third clamp rods 50*a*, 50*b*, 50*c* maintain their position relative to the platform 30 and frame 20 due to gravity. As the lift truck 100 raises platform 30 and frame 20, which preferably are in a fixed relationship, horizontal member 24 approaches clamp 70. As the platform 30 and frame 20 continue to rise, the horizontal member 24 engages and lifts clamp 70. Since clamp 70 and the clamp rods 50 are preferably fixed together, the continued raising by lift truck 100 of the platform 30 and frame 20 causes the clamp 70 to pull the lower clamp rod ends 54*a*, 54*b*, 54*c* from engagement with the ground 110. An operator can then move the lift truck 100 with the lift truck platform apparatus 12 securely supporting the rolling racks 120 and the clamp rods 50 raised off the ground 110. Alternately, fixtures, such as stoppers, washers, nuts, flanges and the like, can be attached at the lower clamp rod ends 54 proximate to the platform 30 to limit the relative vertical movement of the clamp rods 50 to the platform 30.

The present disclosure also provides a method of securing rolling racks on a lift truck platform. The method includes positioning the rolling rack or racks on the platform and moving the platform upward relative to a rack clamp such that the clamp engages the rolling rack. The lift truck platform may then be moved using a lift truck. The present disclosure also provides a method of releasing rolling racks from a lift truck platform. The method includes lowering the lift truck platform and moving the platform downward relative to a rack clamp such that the rack clamp disengages the rolling racks.

Thus, it is seen that the apparatus and methods disclosed herein achieve the ends and advantages previously mentioned. Numerous changes in the arrangement and construction of the parts and steps will be readily apparent to those skilled in the art, and are encompassed within the scope and spirit of the present invention as defined by the appended claims.

What is claimed is:

1. A lift truck platform apparatus for transporting at least one rolling rack using a lift truck, the rolling rack including wheels and bars, the lift truck including first and second vertically moveable forks, the apparatus comprising:

a platform;

a frame extending upwardly from the platform;

a plurality of rods, each rod traversing the platform and at least a portion of the frame;

a clamp attached to each rod opposite the platform, wherein the clamp is vertically moveable relative to the platform; and the platform further including a first outer wheel tray, a second outer wheel tray and a middle wheel tray.

2. The apparatus of claim 1, further including:

a first fork channel positioned between the first outer wheel tray and the middle wheel tray;

a second fork channel positioned between the second outer wheel tray and the middle wheel tray;

each fork channel shaped to accept one of the forks of the lift truck.

3. The apparatus of claim 1, wherein the first outer wheel tray and the middle wheel tray are permanently fixed to the first fork of the lift truck and the second outer wheel tray and the middle wheel tray are permanently fixed to the second fork of the lift truck.

4. The apparatus of claim 1, wherein the first outer wheel tray, the second outer wheel tray and the middle wheel tray are shaped to accept at least one of the wheels of the rolling rack.

5. A lift truck platform apparatus for transporting at least one rolling rack using a lift truck, the rolling rack including wheels and bars, the lift truck including first and second vertically moveable forks, the apparatus comprising:

a platform;

a frame extending upwardly from the platform;

a plurality of rods, each rod traversing the platform and at least a portion of the frame;

a clamp attached to each rod opposite the platform, wherein the clamp is vertically moveable relative to the platform;

wherein the platform is shaped to removably engage the first and second forks during operation of the lift truck; and wherein the clamp includes a plurality of clamp recesses, each clamp recess shaped to accept one of the bars of the rolling rack.

6. A lift truck platform apparatus for transporting at least one rolling rack using a lift truck, the rolling rack including wheels and bars, the lift truck including first and second vertically moveable forks, the apparatus comprising:

a platform;

a frame extending upwardly from the platform;

a plurality of rods, each rod traversing the platform and at least a portion of the frame;

a clamp attached to each rod opposite the platform, wherein the clamp is vertically moveable relative to the platform;

wherein the platform is shaped to removably engage the first and second forks during operation of the lift truck;

further including an open position and a closed position, wherein movement of the platform relative to the ground transitions the apparatus between the open position and the closed position; and wherein vertically upward movement of the platform moves the frame toward the clamp and into the closed position and vertically downward movement of the platform moves the frame away from the clamp and into the open position.

7. A lift truck platform apparatus for transporting at least one rolling rack using a lift truck, the rolling rack including wheels and bars, the lift truck including first and second vertically moveable forks, the apparatus comprising:

a platform including:

a first outer wheel tray;

a second outer wheel tray;

a middle wheel tray;

a first fork channel positioned between the first outer wheel tray and the middle wheel tray;

a second fork channel positioned between the second outer wheel tray and the middle wheel tray; and each fork channel shaped to accept one of the forks of the lift truck;

a frame extending upwardly from the platform;

at least one rod operatively attached to the platform and at least a portion of the frame; and a clamp attached to the at least one rod opposite the platform, wherein the clamp is vertically moveable relative to the platform and frame.

8. The apparatus of claim 7, wherein:

the frame extends upwardly from the middle wheel tray of the platform and further includes a horizontal member positioned opposite the platform;

the at least one rod passes through the middle wheel tray and the horizontal member and positions the clamp generally above the horizontal member.

9. The apparatus of claim 8, wherein the at least one rod includes an upper rod end that extends past the horizontal member, and the at least one rod includes a lower rod end that extends past the platform.

10. The apparatus of claim 8, wherein the frame further includes a plurality of rod guides and each rod traverses one of the rod guides.

11. The apparatus of claim 8, further including an open position where the clamp is spaced from the horizontal member and a closed position where the clamp is proximate to the horizontal member, wherein movement of the platform relative to the ground transitions the apparatus between the open position and the closed position.

12. The apparatus of claim 11, wherein vertically upward movement of the platform moves the frame toward the clamp and into the closed position and vertically downward movement of the platform moves the frame away from the clamp and into the open position.

13. The apparatus of claim 7, wherein:

the first outer wheel tray, the second outer wheel tray and the middle wheel tray are shaped to accept at least one of the wheels of the rolling rack; and the clamp includes a plurality of clamp recesses, each clamp recess shaped to accept one of the bars of the rolling rack.

14. A lift truck platform apparatus for transporting at least one rolling rack using a lift truck, the rolling rack including wheels and bars, the lift truck including first and second vertically moveable forks, the apparatus comprising:

a platform;

a frame extending upwardly from the platform and including a horizontal member positioned opposite the platform;

a plurality of rods, each rod including an upper rod end that extends past the horizontal member and each rod including a lower rod end that extends past the platform; and a clamp attached to each rod opposite the platform, wherein the clamp is positioned generally above the horizontal member and is vertically moveable relative to the platform and frame, the clamp including a plurality of clamp recesses, wherein each clamp recess is shaped to accept one of the bars of the rolling rack.

15. The apparatus of claim 14, the platform further including:

a first outer wheel tray;

a second outer wheel tray;

a middle wheel tray;

each wheel tray shaped to accept at least one of the wheels of the rolling rack;

a first fork channel positioned between the first outer wheel tray and the middle wheel tray;

a second fork channel positioned between the second outer wheel tray and the middle wheel tray; and each fork channel shaped to accept one of the forks of the lift truck.

16. The apparatus of claim 14, further including:

an open position where the clamp is spaced from the horizontal member;

a closed position where the clamp is proximate to the horizontal member;

wherein movement of the platform relative to the ground transitions the apparatus between the open position and the closed position; and wherein vertically upward movement of the platform moves the frame toward the clamp and into the closed position and vertically downward movement of the platform moves the frame away from the clamp and into the open position.

* * * * *